US009723669B2

(12) United States Patent
Sedzin et al.

(10) Patent No.: US 9,723,669 B2
(45) Date of Patent: Aug. 1, 2017

(54) LED LIGHTING SYSTEM AND CONTROLLER, A METHOD OF CONTROLLING A PLURALITY OF LEDS, AND A COMPUTER PROGRAM THEREFOR

(71) Applicant: NXP B.V., Eindhoven (NL)

(72) Inventors: Aliaksei Vladimirovich Sedzin, Eindhoven (NL); Marc Vlemmings, Eindhoven (NL)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 15/200,076

(22) Filed: Jul. 1, 2016

(65) Prior Publication Data

US 2017/0006676 A1 Jan. 5, 2017

(30) Foreign Application Priority Data

Jul. 2, 2015 (EP) ..... 15175023

(51) Int. Cl.

| | |
|---|---|
| ***H05B 37/00*** | (2006.01) |
| ***H05B 33/08*** | (2006.01) |
| ***F21V 29/70*** | (2015.01) |
| *F21Y 103/10* | (2016.01) |
| *F21Y 115/10* | (2016.01) |

(52) U.S. Cl.

CPC ..... *H05B 33/0815* (2013.01); *F21V 29/70* (2015.01); *H05B 33/0827* (2013.01); *H05B 33/0845* (2013.01); *H05B 33/0854* (2013.01); *H05B 33/0857* (2013.01); *F21Y 2103/10* (2016.08); *F21Y 2115/10* (2016.08)

(58) Field of Classification Search

CPC ..... H05B 33/0815; H05B 33/0827; H05B 33/0845; H05B 33/0857; F21V 29/70; F21Y 2103/10; F21Y 2115/10

USPC ..... 315/186

See application file for complete search history.

(56) References Cited

U.S. PATENT DOCUMENTS 8,605,764 B1 * 12/2013 Rothaar ..... G02B 27/01 372/29.01

2010/0202141 A1 8/2010 Hui (Continued)

OTHER PUBLICATIONS

Extended European Search Report for Patent Appln. No. 15175023.9 (Jan. 4, 2016).

(Continued)

*Primary Examiner* — Daniel D Chang

(57) ABSTRACT

An LED lighting system is disclosed comprising: a heatsink; a plurality of strings of LEDs each string comprising one or more LEDs each having a junction and being mounted on the heatsink, and a controller comprising a memory unit and a processor and being configured to supply a current to each of the strings of LEDs; the processor comprises: a first temperature estimation subunit configured to generate an estimate of a temperature of the junction of a one of strings of LEDs; a heatsink temperature estimation subunit configured to estimate a temperature of the heatsink unit from the first estimate; and a second temperature estimation subunit configured to provide an estimate of a temperature of the junction of a second string of LEDs, from the estimated temperature of the heatsink. A controller for and method of operating a plurality of LEDs are also disclosed.

14 Claims, 5 Drawing Sheets

(56) References Cited

U.S. PATENT DOCUMENTS

| | | | | |
|---|---|---|---|---|
| 2011/0156593 | A1 | 6/2011 | De Greef et al. | |
| 2016/0323972 | A1 * | 11/2016 | Bora ..... | H05B 33/0842 |

OTHER PUBLICATIONS

Hulett, Jeff et al; "Measuring LED Junction Temperature"; Photonics Sepctra; retrieved from the Internet http://www.photonics.com/Article.aspx?AID-34316 on Jun. 20, 2016; 7 pages. (Jul. 2008).

Keeping, Steven; "Calculating LED Junction Temperature in Lighting Applications"; retrieved from the Internet http://www.digikey.com/en/articles/techzone/2011/jun/calculating-led-junction-temperature-in-lighting-applications on Jun. 20, 2016; Electronic Products; 3 pages. (Jun. 7, 2011).

* cited by examiner

LED LIGHTING SYSTEM AND CONTROLLER, A METHOD OF CONTROLLING A PLURALITY OF LEDS, AND A COMPUTER PROGRAM THEREFOR

CROSS-REFERENCE TO RELATED APPLICATIONS

This application claims the priority under 35 U.S.C. §119 of European patent application no. 15175023.9, filed Jul. 2, 2015 the contents of which are incorporated by reference herein.

FIELD

This present disclosure relates to LED lighting systems, controllers therefor, and to methods of controlling a plurality of LEDs.

BACKGROUND

Knowledge of the junction temperature of an LED can be useful to control the output of the LED. Typically, the peak wavelength and perceived colour of an LED depends on the operating temperature. Furthermore the luminous intensity of an LED can vary with temperature.

Although it is possible to measure the temperature of the LED, the temperature in the critical region—that is to say, the junction, which is typically a pn junction for a conventional LED—is generally not directly accessible. In the case that the LED is mounted on a heatsink, a temperature sensor may typically be mounted on the heatsink, and the temperature of the LED estimated from the measured heatsink temperature, by generating a thermal model of the arrangement, in order to estimate a temperature off-set between the measured heatsink temperature and the LED junction.

Recently, techniques have been developed by the applicant to directly estimate the junction temperature of an LED, based on its electrical characteristics. Such techniques do not require use of a separate temperature sensor, and may be referred to a "sensor-less sensing". In particular it has been recognised that LED current-voltage characteristic ("IV curve") of an LED has a well-defined relationship with temperature. Even a single measurement of the voltage across an LED at a specified operating current may thus be used to estimate the LED junction temperature, according to the well-known diode equation:

$$I = I_0 \cdot \left(e^{\frac{q \cdot (V - I \cdot R_S)}{nkt}} - 1\right).$$

The applicant has refined these techniques to provide an estimation of the junction temperature from the voltage across the LED at a high current, and the voltage across the LED at a relatively lower current. Typically, the high current may be of the order of 10 mA to 10 A, and the relatively lower current may be of the order of 100 μA or less.

In particular, in applications where it is desirable to measure the temperature of a plurality of LEDs, the processing power required to apply such techniques might be considerable and not readily available. Such applications include use cases where an array of LEDs is required with matched operating wavelengths, or applications in which differently coloured LEDs (for instance, red, green and blue—RGB, or red, green blue and white—RGBW) are combined to provide a specific luminosity and perceived colour.

SUMMARY

According to a first aspect of the present disclosure there is provided an LED lighting system comprising: a heatsink; a plurality of strings of LEDs each having a junction and being mounted on the heatsink, and a controller comprising a memory unit and a processor and being configured to supply a current to each of the strings of LEDs; wherein the processor comprises: a first temperature estimation subunit configured to generate a first estimate, being an estimate of a junction temperature of the LEDs of a one of the strings of LEDs; a heatsink temperature estimation subunit configured to estimate a temperature of the heatsink unit from the first estimate; and a second temperature estimation subunit configured to provide a second estimate, being an estimate of a junction temperature of the LEDs of a second string of LEDs, from the estimated temperature of the heatsink. Thus according to the LED lighting system of this aspect, a separate temperature-measuring component or circuitry is not required for each of the strings of LEDs. Moreover, the system provides that an estimation of a single string of LEDs' junction temperature be used to estimate the junction temperatures of others of a plurality of LEDs, sharing the same heatsink. Thus, according to this aspect it is not required to directly estimate the junction temperature of all of the strings of LEDs. As will be described in more detail below with regard to specific embodiments, this aspect relies on calculating the heatsink temperature from an LED string's junction temperature. The present inventors have appreciated that, at least for present purposes, it can be beneficial to estimate a heatsink temperature from the temperature of an operating LED, rather than vice-versa.

In one or more embodiments, the controller unit is configured to supply a PWM current to the first string of LEDs during an estimation phase during which the PWM has a high current time, and a low current time during which the current is non-zero. Thus the PWM current may be supplied as alternating high-current and low-current times ("high-low"), the low current being sufficiently small that the light emitted by the LEDs is negligible. The PWM current may be "high-low" during only an estimation phase, or may be high-low during other operational times (for instance when the LEDs are providing a luminous output but the temperature is not being estimated). Alternatively, low-current time of the PWM may not occupy the entire gap between pulses, as will be described in more detail below.

In one or more embodiments, the first temperature estimation subunit is configured to provide the estimate of the temperature of the junctions of the first string of LEDs during the estimation phase, from a difference between a voltage across the string of LEDs during the high current part, and a voltage across the LEDs during the low current part.

In one or more other embodiments, the controller unit is configured to supply a PWM pulse having a high current part and a low current part, and the first temperature estimation subunit is configured to provide the estimate of the junction temperature of the LEDs of the first string of LEDs from a voltage across the LEDs during the low current part.

In one or more embodiments, the heatsink temperature estimation subunit is configured to estimate the heatsink from an average current through the first string of LEDs and the estimated junction temperature of LEDs of the first string of LED. The average current may be defined as the total charge passing through the LED divided by the PWM period. In embodiments in which the PWM consists of a high current (I_high) and zero current, the average current is then simply given by I_high multiplied by the PWM duty cycle (which lies between 0, that is to say permanently off and 1 or 100%, that is to say permanently on).

In one or more embodiments, the memory unit is configured to store a lookup table defining a temperature difference between junction temperature of the LEDs of the first string of LEDs and the heatsink temperature for a plurality of average currents, and the heatsink temperature estimation subunit is configured to estimate the heatsink temperature using the lookup table. The lookup table may further define a temperature difference between junction temperature of the LEDs of the second string of LEDs and the heatsink temperature for a plurality of average currents, and the second LED estimation subunit is configured to estimate the junction temperature of the LEDs of the second string of LEDs using the lookup table. Such a lookup table may be relatively intensive on memory—but relatively light on processing requirements. Alternative embodiments, to which the present disclosure extends, will be readily apparent, for instance where a look-up table is not used, but the relationship between the average current and the temperature offset is determined—for example by performing a linear or quadratic "best-fit" to measured data, and the resulting coefficients are used to estimate the offset for any specific average current.

In one or more embodiments the LED system comprises a string of red LEDs, a string of blue LEDs a string of green LEDs and a string of white LEDs, and the first string of LEDs is the string of red LEDs. In one or more other embodiments the plurality of strings of LEDs further comprises a string of white LEDs. Systems and methods according to the present disclosure are particularly useful, in applications in which the strings of LEDs are different colour LEDs, since different colour LEDs may have significantly different variations with temperature (as will be discussed in more detail hereinbelow) and operate at significantly different temperatures, even with the same average current. In such multi-coloured LED systems, it may be convenient to directly estimate the junction temperature of the red LED or LEDs and use this to indirectly estimate the junction temperatures of the other LEDs. As will be discussed further hereinbelow, red LEDs tend to have a higher temperature sensitivity (for both luminous output and peak wavelength) than other colour LEDs.

According to another aspect of the present disclosure, there is provided a controller configured for use in an LED system having a heatsink and a plurality of strings of LEDs (110, 111, 112, 113) each string comprising one or more LEDs each having a junction (115) and being mounted on the heatsink, the controller comprising: a memory unit (310) and a processor (320) and being configured to supply a respective current to each of the strings of LEDs; wherein the processor comprises: a first temperature estimation subunit (322) configured to generate a first estimate, being an estimate of the junction temperature of the LEDs of a one of the strings of LEDs; a heatsink temperature estimation subunit (324) configured to estimate a temperature of the heatsink unit from the first estimate; and a second temperature estimation subunit (326) configured to provide a second estimate, being an estimate of a junction temperature of LEDs of a second string of LEDs, from the estimated temperature of the heatsink.

According to another aspect of the present disclosure, there is provided a method of estimating the temperature of a plurality of strings of LEDs each having a junction and mounted on a common heatsink and being supplied by a respective PWM current, the method comprising: estimating the junction temperature of a first string of LEDs of the plurality of strings of LEDs; calculating or estimating the temperature of the heatsink from the estimate of the junction temperature of the first string of LEDs; and estimating the temperature of a second string of LEDs of the plurality of strings of LEDs from the estimated temperature of the heatsink.

In one or more embodiments estimating the temperature of the first string of LEDs comprises measuring a first voltage across the string of LEDs during a high current part of a first LED PWM current, measuring a second voltage across the string of LEDs during a low current part of a first LED PWM current, and estimating the junction temperature from a difference between the first and second voltages.

In one or more embodiments the temperature of the heatsink is estimated from an average current through the first string of LEDs and the estimated junction temperature of the first string of LEDs. A temperature offset between the junction temperatures of the first string of LEDs and the heatsink may be estimated from the average current.

In one or more embodiments a temperature offset between the first LED junction temperature and the heatsink is determined from the average current using a lookup table. Similarly, in one or more embodiments the temperature of a second string of LEDs of the plurality of strings of LEDs is estimated from the estimated temperature of the heatsink and an average current through the second string of LEDs.

In one or more embodiments the plurality of strings of LEDs comprises a string of red LEDs being the first string of LEDs, and at least one of a string of blue LEDs and a string of green LEDs. In one or more other embodiments the plurality of strings of LEDs further comprises a string of white LEDs.

There may be provided a computer program, which when run on a computer, causes the computer to configure an LED lighting system as disclosed herein to perform any method disclosed herein. The computer program may be a software implementation, and the computer may be considered as any appropriate hardware, including a digital signal processor, a microcontroller, and an implementation in read only memory (ROM), erasable programmable read only memory (EPROM) or electronically erasable programmable read only memory (EEPROM), as non-limiting examples. The software implementation may be an assembly program.

The computer program may be provided on a computer readable medium, which may be a physical computer readable medium, such as a disc or a memory device, or may be embodied as a transient signal. Such a transient signal may be a network download, including an internet download.

These and other aspects of the invention will be apparent from, and elucidated with reference to, the embodiments described hereinafter.

BRIEF DESCRIPTION OF DRAWINGS

Embodiments will be described, by way of example only, with reference to the drawings, in which.

Figure 1:
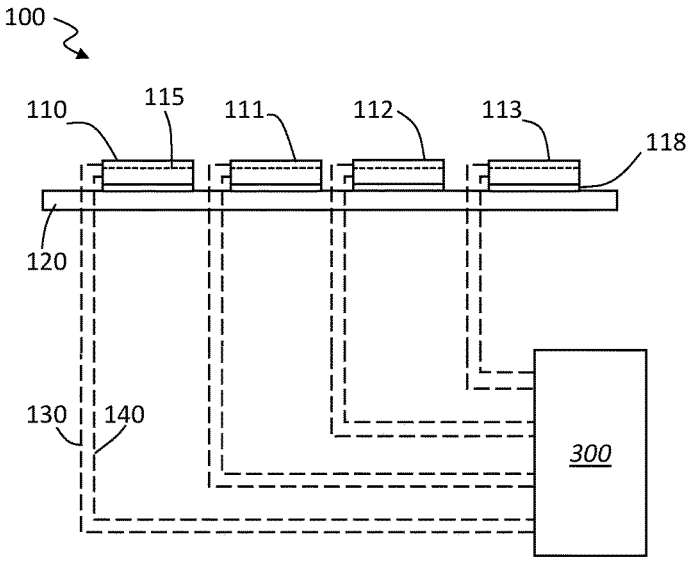
FIG. 1 shows a schematic diagram of an LED system according to the present disclosure.

It should be noted that the Figures are diagrammatic and not drawn to scale. Relative dimensions and proportions of parts of these Figures have been shown exaggerated or reduced in size, for the sake of clarity and convenience in the drawings. The same reference signs are generally used to refer to corresponding or similar features in modified and different embodiments

DETAILED DESCRIPTION OF EMBODIMENTS

FIG. 1 shows a block diagram of an LED system 100 according to the present disclosure. As shown in the figure, the LED system comprises a plurality of strings of LEDs 110, 111, 112, 113, the LEDs being are mounted on a common heatsink 120. The LEDs may be attached to the heatsink 120 by for instance a eutectic material or a high thermal conductivity adhesive 118, or by other methods with which the skilled person will be familiar. The LEDs are thereby in good thermal contact with the heatsink. The LEDs each have a junction 115. In the case of conventional LEDs the junction is a pn junction. The LEDs are electrically coupled to a controller 300 by means of electrical connections 130, 140. In the cases that the strings of LEDs each consist of just one LED (as shown), the electrical connections 130, 140 respectively connect opposite sides of the PN junction 115 of the LED 110 to the controller 300. In the case that one or more of the strings of LEDs comprise a plurality of series-connected LEDs, the junctions of the LEDs are connected in series, and the electrical connections 130, 140 for that string or strings are respectively connected to the N-side or cathode of a first LED in the string and the P-side or anode of a last LED in the string. It will be appreciated that, as an alternative to separate electrical connections 140, there may be a common ground, or earth electrical connection, which may be, for instance, provided through the heatsink 120.

Figure 2:
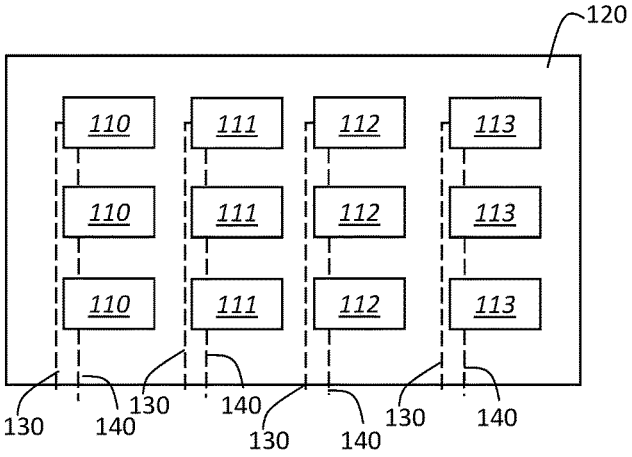
FIG. 2 shows a plan view of an LED system such as that shown in FIG. 1.

FIG. 2 shows, schematically, a plan view of an arrangement comprising 4 strings of LEDs 110, 111, 112 and 113, each string comprising 3 LEDs connected in series, and the strings being connectable to a controller (not shown) by means of electrical connections 130, 140. The strings of LEDs are mounted on a common heatsink 120.

Thus, each string of LEDs 110 may be a single LED or a series-connected plurality of LEDs. In a typical application, each string of LEDs comprises between 1 and 20 LEDs; 20 red LEDs may be operated in series provided from a 50V supply, which would generally be considered to be safe. However, the number of LEDs in the string is not limited to 20.

In a typical application, the strings of LEDs 110 . . . 113 respectively are red LEDs 110, blue LEDs 111, green LEDs 112 and white LEDs 113. In an example application for retrofitting to 12V bulbs, there may be three strings, of red, green and blue LEDs and respectively comprising 5, 4 and 2 LEDs. In other applications, the strings may each be the same colour. The strings may be separately controllable, that is to say, a different current level may be provided to each of the strings. The current provided to each of the strings may vary with the colour of the LEDs in the string. Varying the current in dependence on the string colour may be useful in order to vary the perceived colour of the overall light output. In other applications, the current provided to each of the strings may vary with their spatial position on the heatsink. Varying the current to each string, in dependence on its spatial position on the heatsink, may be useful for instance to provide beamforming.

Figure 3:
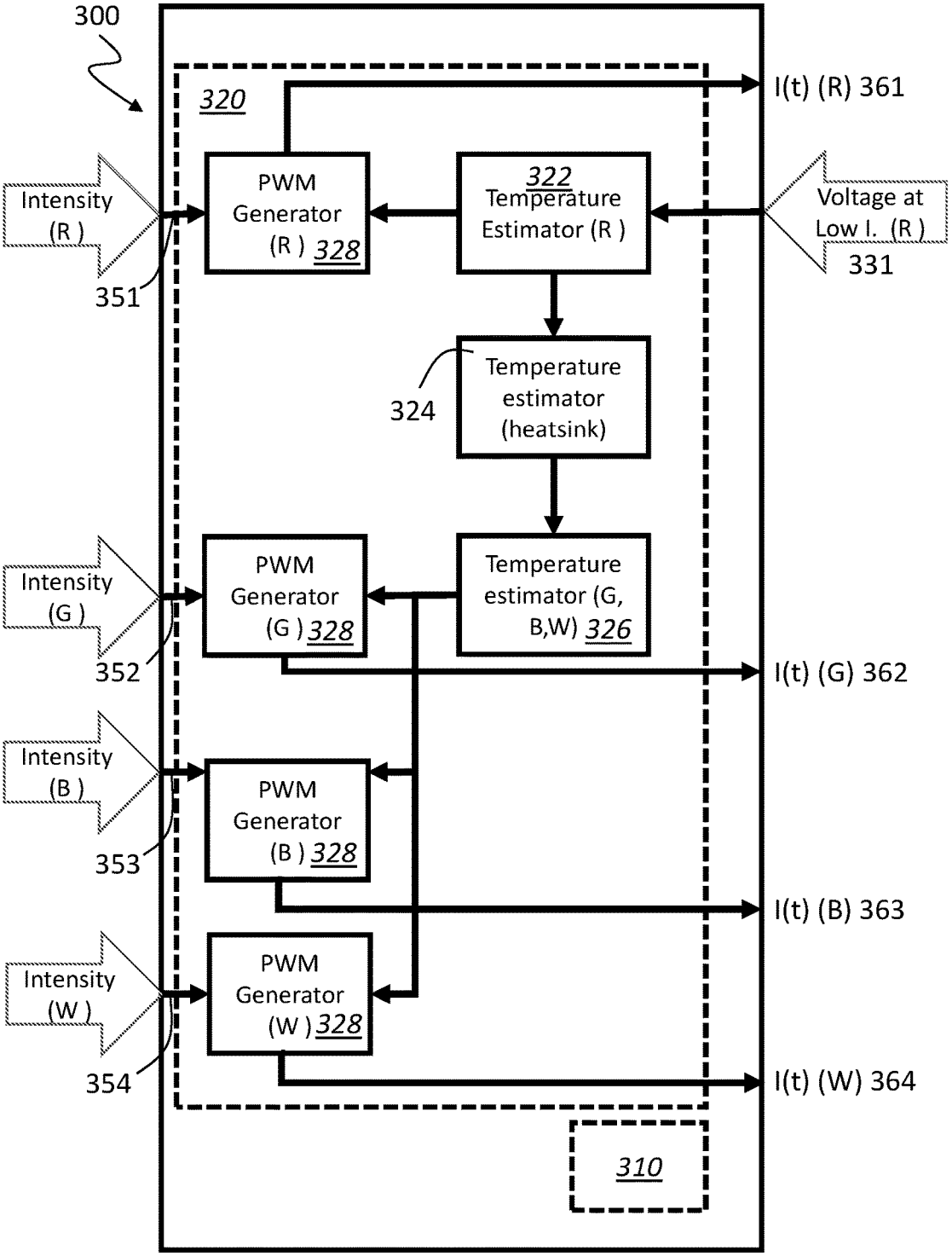
FIG. 3 shows a block diagram of a controller according to the present disclosure.

FIG. 3 shows, schematically, a block diagram of a controller 300 according to one or more embodiments. The controller 300 may comprise a memory unit 310, and a processor 320. The processor 320 may comprise a first temperature estimation subunit 322, a heatsink temperature estimation subunit 324, and a second temperature estimation subunit 326. In addition, the processor 320 may comprise one or more PWM generators 328. The controller 300 may receive as inputs, a requested luminous intensity 351, 352, 353, 354 for each of the strings of LEDs, and the voltage at low current 331 for the red string; it may provide as outputs a respective average operating current 361, 362, 363, 364 for each of the strings of LEDs. The average current may be a constant current, or may be a PWM current, as will be explained in more detail hereinbelow. The current may thus be a function of time, that is to say, $I=I(t)$.

As already discussed, the output of an LED depends on the junction temperature of the LED. Here, output may refer to one or both of intensity and peak wavelength. Note that in the discussion that follows, it will be assumed that each of the LEDs in a string of LEDs has similar characteristics. In the case that the string consists of just one LED, this is necessarily the case a fortiori; in this case that the string consists of two or more LEDs, it is thus the case that the LEDs should be appropriately similar. For some applications it may be required that the LEDs are matched; however, in general this has not been found to be necessary. In other applications it may simply be the case that the LEDs are of the same or similar type or nominal output colour—for example they may all be 'red' LEDs, or all be 'white' LEDs. In other applications even this is not required—in particular, the sensor-less sensing techniques developed by the applicant may be used for characterization of temperature and light (for a string with any combination of LEDs provided only that there is consistency between a characterization (reference) lamp and the production lamps.

Furthermore, in the discussion that follows, it will be assumed that each of the LEDs in a single string has the same, or similar, junction temperature. Since the LEDs are series connected and thus the same current passes through each LED, and the LEDs are assumed to have similar characteristics, it may be expected that the junction temperature of the LEDs is the same. Herein the term "junction temperature" in relation to a string is used to refer to the average of the junction temperatures of the individual LEDs in the string.

Figure 4:
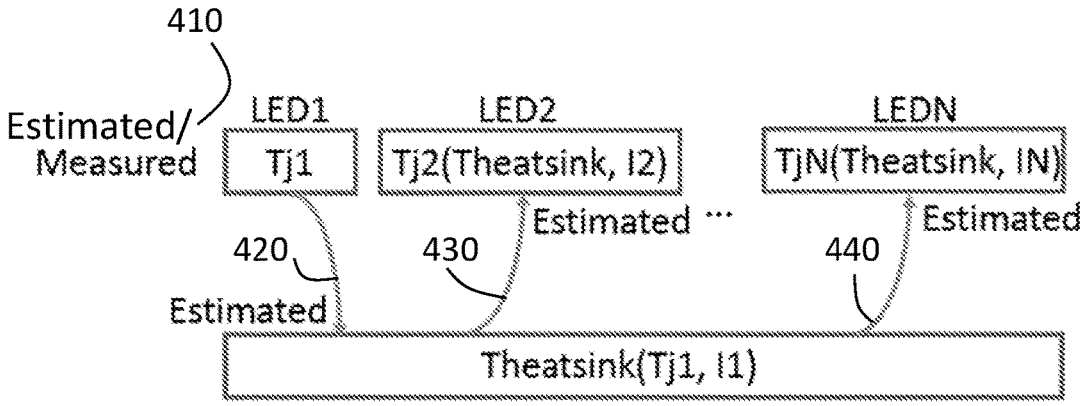
FIG. 4 illustrates, schematically, a method according to the present disclosure.

Turning to FIG. 4, this figure illustrates, schematically, a method according to the present disclosure. The method comprises three elements or steps. In a first element or step, the junction temperature Tj1 of the LED or LEDs in a first string, is estimated or measured, under operating conditions having an average current I1, as shown as 410. The estimate Tj1 is then used in a second element of step, in order to estimate the temperature of the heatsink, (Theatsink), as shown at 420 The temperature of the heatsink is a function of both the junction temperature (Tj1) of the first LED and the average current I1 through the LED. That is to say, $$T\text{heatsink}=T\text{heatsink}(I1,Tj1).$$

In a third element or step, the junction temperature Tj2 of the second string of LEDs is estimated from the heatsink temperature and the average current I2, as shown at 430. The method may be extended to estimate the junction temperature (TjN) of each of one or more further strings of LEDs, as shown at 440. In such cases, the third step may be repeated, for each of the LEDs strings with the exception of the first, or reference string. Furthermore, it may be the case that the junction temperature Tj1 of LED or LEDs in the first string is estimated, or polled, on a relatively infrequent basis, and the temperatures of the other strings are estimated relatively frequently, using the third step; the third step may thus be iterated multiple times. Furthermore, it will be appreciated that the temperature of the heatsink depends on the total thermal input to the heatsink and that depends on the current through all of the strings of LEDs.

Figure 5:
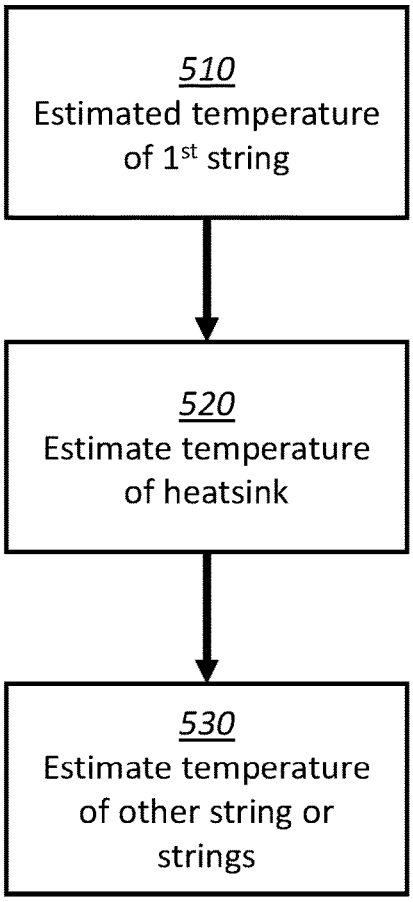
FIG. 5 is a flowchart of a temperature estimation method according to the present disclosure.

A flow chart corresponding to such a method is shown in FIG. 5: at 510 the temperature of the first string is estimated. This is done by directly measuring the junction temperature by a so-called "sensorless sensing" method. At 520 the temperature of the heatsink is estimated. This estimation uses the temperature of the first string, and the average current through the first string in order to determine the offset between the junction temperature of the first string and the temperature of the heatsink. At 530 the temperature of one or more other strings is estimated using the temperature of the heatsink and the average current through that other string.

In order to estimate the temperature of the heatsink, a thermal model of the LED system may be used. In particular, the temperature difference between the heatsink and LED junction depends on the average current through the LED: this determines the heat generated by the LED, and the thermal conductivity of the LED itself (together with any mounting eutectic, compound or adhesive 118) will determine the temperature difference, or offset, between the LED junction and the heatsink.

Figure 6:
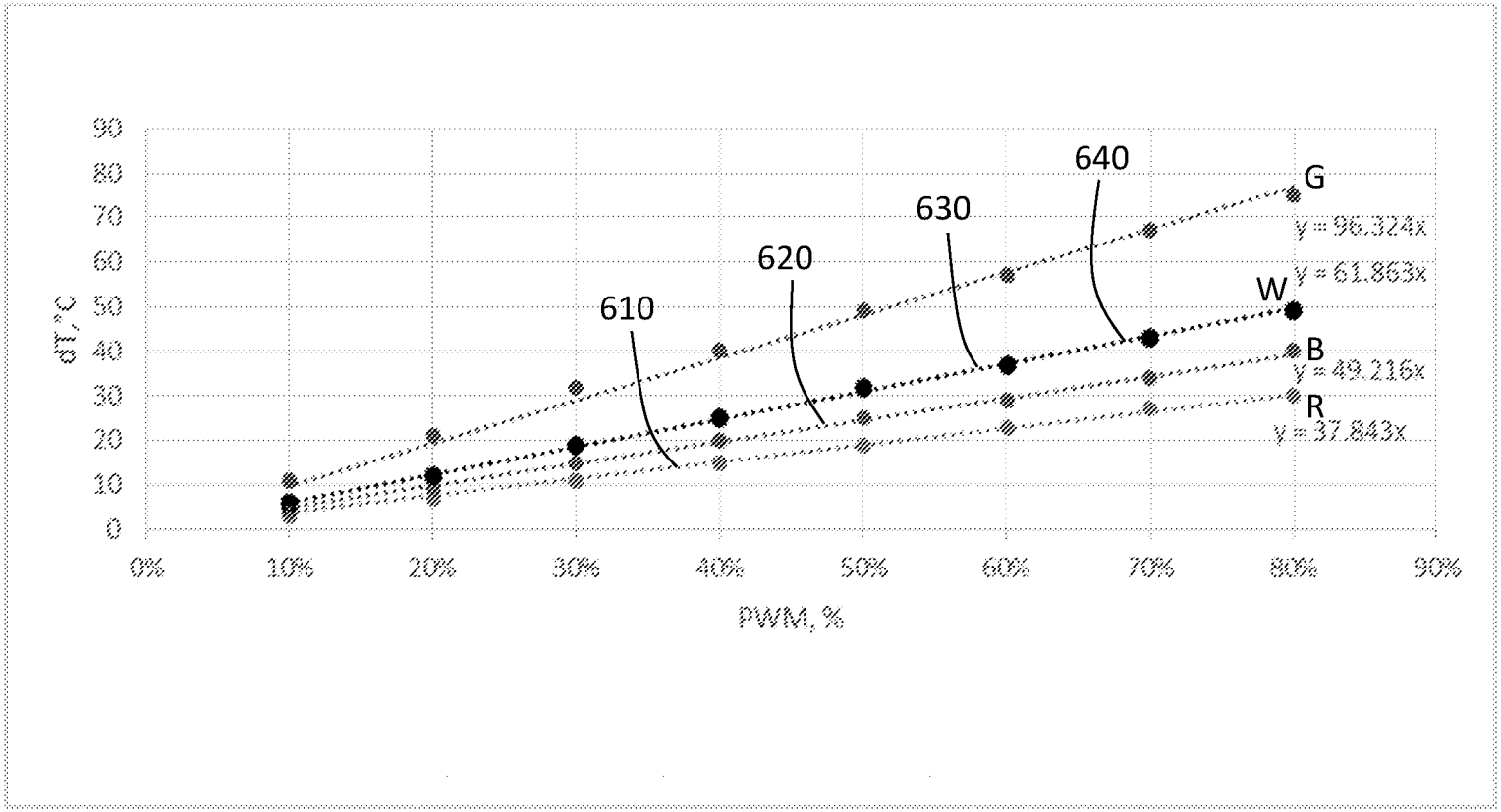
FIG. 6 is a graph showing temperature offset between an LED junction and heatsink measured against average current for different types of LED.

The temperature offset may be estimated, or may be measured. An example of measurements of the temperature offset, dT is shown in FIG. 6 in which the offset dT is measured against average current, for four types of LED. In the example shown in FIG. 6, the four types of LED are red, R 610, blue, B, 620, white, W, 630 and green G, 640. As can be seen, the slope of the temperature offset varies between the four different types of LED.

The average current is varied by a providing a PWM current (with a fixed high current value during the "on" pulse) with a PWM duty cycle which is varied between 10% and 90%. Thus, if the high current level is given by I_high, and the duty cycle by D, the average current is simply I_high×D.

A look-up table may be used, in which the values of the offset are recorded at different PWM duty cycles for the various types of LEDs. The lookup table may be stored in memory unit 310. Alternatively a best fit may be applied to the curve relating the temperature offset to the PWM duty cycle (or average current). FIG. 5 shows an example of a linear best fit calculation; the coefficients of the best fit curves may be stored in memory unit 310. A linear best fit may be used as shown, or a more sophisticated model may be used by determining for instance a quadratic or higher polynomial best fit curve.

Thus according to the present disclosure, the junction temperatures of just one LED string need be estimated, in particular by directly estimating the junction temperature by use of a "sensorless sensing" technique. This LED string may be considered as the reference LEDs string. The choice of which string is to be used as the reference LED string, may depend on the specific application: in some applications such as specific types of lamp it might be appropriate to choose the LED string which has the greatest impact on the lamp's output, requiring the maximum precision of junction temperature knowledge. This may typically be a red LED string since the luminous flux of red LEDs typically demonstrates a very strong dependence on temperature. In other applications it may be appropriate to use the LED string for which the thermal resistance to the heatsink is the least. This should generally allow for the most accurate estimation of the heatsink temperature—since the offset between the string and the heatsink would typically be expected to be the least—thereby minimizing errors in estimated temperatures of all the other strings. With reference to the LED string shown in FIG. 6, it is noted that this corresponds to the red LED string.

Operation of a method as just described may result in the current through one or more of the strings being varied, with a consequential effect on the temperature of the heatsink. Since the temperature of the junctions in the reference, or first, string depends on the temperature of the heatsink, it may be required to iterate the method multiple times in order to derive accurate temperatures.

Turning back to FIG. 3, it is seen that in this embodiment the strings are each supplied with a PWM signal I(t). It should be noted that in other embodiments, one or more of the strings may be supplied with a constant current I, such that the current is not PWM modulated; in such embodiments, the average current is equal to the constant current (Iavg=I), whereas in the embodiment shown the average current Iavg is equal to the high current I_high multiplied by the duty cycle D, as already mentioned: Iavg=I_high×D. To determine the required average current—which is proportional to the required PWM duty cycle for PWM implementations—the required intensity is translated into a PWM signal by the PWM generators 328 for each string. The PWM generator requires to have knowledge of the temperature of the string. The PWM generator for the reference string (shown as (R)) makes direct use of the estimated temperature of the reference string, as calculated in the temperature estimation subunit 322. Conversely, the PWM generators for the other strings (shown as (G), (B), and (W) make use of the temperature estimated by the respective temperature estimation subunit or subunits 326. A single temperature estimation subunit may provide the estimates for each of the strings as shown, or the estimates may be made by separate temperature estimation subunits. The skilled person will appreciate, that as used herein, the term "constant current" refers to a current which is not PWM modulated, rather than a totally time-invariant current. In practice, the current may vary slowly over time: for example as a lamp heats up, the "constant" current may be varied in order to keep the light output constant. Furthermore, a user may change a lamp's settings over time.

The system may poll the reference string in order to determine the temperature of the junctions, at every PWM cycle. Alternatively, in one or more embodiments the reference string may be polled less frequently, for instance at 100 ms intervals, or 1 s intervals. Particularly for slow-changing or steady-state lighting applications the temperature may be expected not to vary or fluctuate rapidly, and a low frequency of polling (such as at 1 s or longer intervals) will generally reduce the calculation burden on the system. An estimation phase may occur relatively infrequently, such as at intervals of 1 s or longer.

Furthermore, a multilevel PWM signal may be used, such as will be familiar to the person skilled in the art of senseless and sensing. Such a multilevel PWM signal may include an "on" or "high" time during which the LED is providing luminous output; the gap between these pulses may incorporate both a "low" time during which the temperature of the junction is determined, and an "off" or zero time.

It will be appreciated, that although in FIG. 3 the subunits 322, 324 and 326 are shown as separate elements of the processor 320, along with separate PWM generators, the functions provided by the subunits may be combined into a single subunit or differently distributed between subunits; in the instance of implementation of methods according to the present disclosure either partly or completely in software, the subunits may form a separate or overlapping routines comprised in a set of operating instructions.

Figure 7:
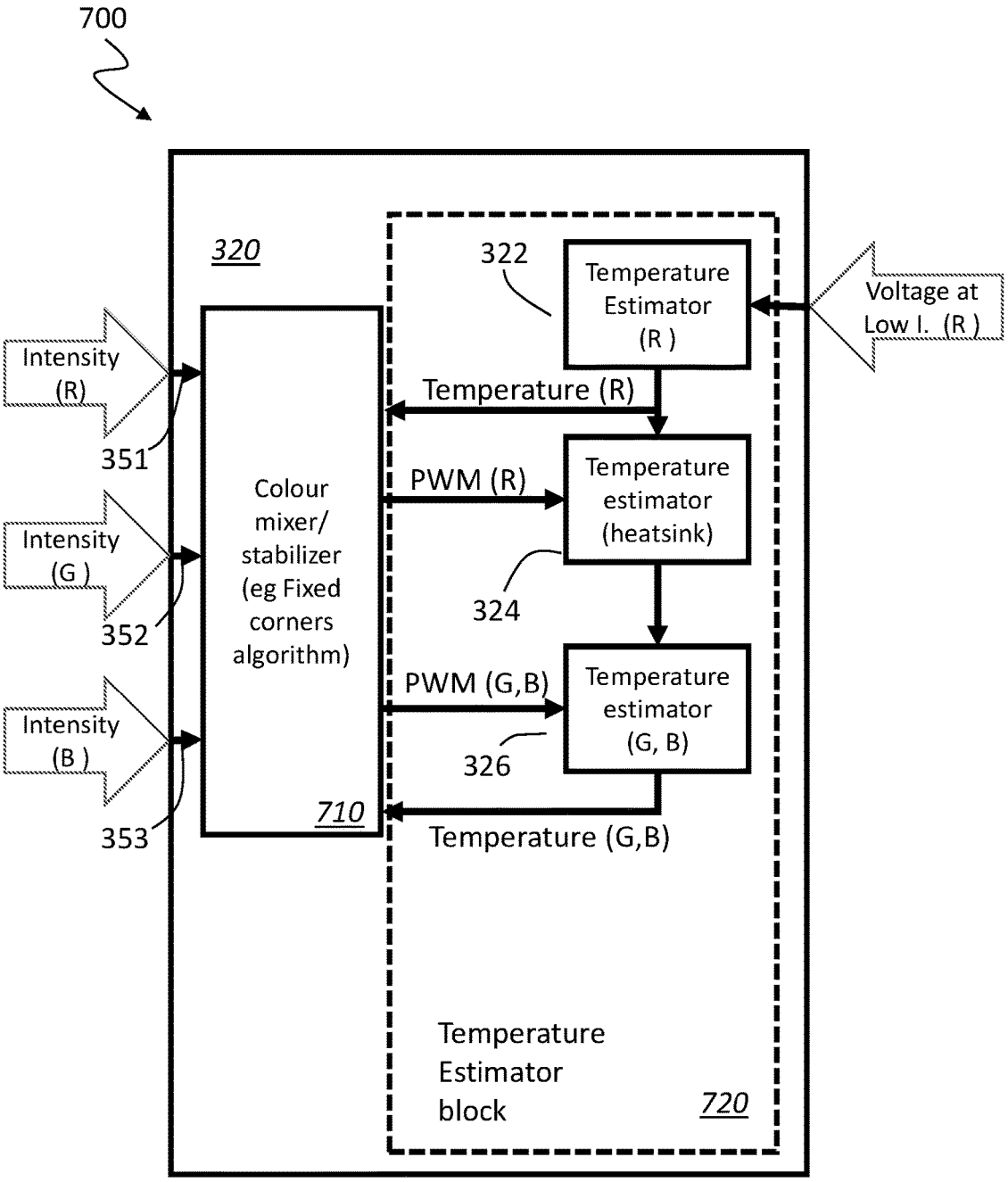
FIG. 7 shows a block diagram of another controller according to the present disclosure.

An example of such an alternative configuration, is shown in FIG. 7. This figure shows a block diagram of a controller according to one or more embodiments of the present disclosure. This controller 700 comprises a processor 320. As shown, the processor 320 may comprise a first temperature estimation subunit 322, a heatsink temperature estimation subunit 324, and a second temperature estimation subunit 326. These subunits may all be configured or arranged as part of a temperature estimator block 720. The controller may further comprise a colour mixer/stabilizer subunit 710. The colour mixer/stabilizer subunit 710 may, for instance, use a fixed corners algorithm to stabilise and/or mix the colours from the separate LEDs strings. The required red, green and blue intensities (for a three-colour lamp as shown) may be input to the colour mixer/stabilizer sub-unit 710. The temperature estimator block may receive as an input 331 the voltage at low current for the red string, and the PWM levels for each string, and provide, as output to the colour mixer/stabilizer subunit 710 temperature estimates for each string.

From reading the present disclosure, other variations and modifications will be apparent to the skilled person. Such variations and modifications may involve equivalent and other features which are already known in the art of LED systems and methods, and which may be used instead of, or in addition to, features already described herein.

Although the appended claims are directed to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable sub-combination. The applicant hereby gives notice that new claims may be formulated to such features and/or combinations of such features during the prosecution of the present application or of any further application derived therefrom.

For the sake of completeness it is also stated that the term "comprising" does not exclude other elements or steps, the term "a" or "an" does not exclude a plurality, a single processor or other unit may fulfil the functions of several means recited in the claims and reference signs in the claims shall not be construed as limiting the scope of the claims.

The invention claimed is:

1. An LED lighting system comprising:

a heatsink;

a plurality of strings of LEDs each string comprising one or more LEDs each having a junction and being mounted on the heatsink, and a controller comprising a memory unit and a processor and being configured to supply a respective current to each of the strings of LEDs;

wherein the processor comprises: a first temperature estimation subunit configured to generate a first estimate, being an estimate of the junction temperature of the LEDs of a one of the strings of LEDs; a heatsink temperature estimation subunit configured to estimate a temperature of the heatsink from the first estimate; and a second temperature estimation subunit configured to provide a second estimate, being an estimate of a junction temperature of LEDs of a second string of LEDs, from the estimated temperature of the heatsink.

2. An LED system as claimed in claim 1, wherein the controller is configured to supply a PWM current to the first string of LEDs during an estimation phase during which the PWM has a high current time, and a low current time during which the current is non-zero.

3. An LED system as claimed in claim 2, wherein the first temperature estimation subunit is configured to provide the estimate of the junction temperature of the LEDs of the first string of LEDs during the estimation phase, from a difference between a voltage across the string of LEDs during the high current time and a voltage across the string of LEDs during the low current time.

4. An LED system as claimed in claim 2, wherein the first temperature estimation subunit is configured to provide the estimate of the junction temperature of the LEDs of the first string of LEDs from a voltage across the string of LEDs during the low current time.

5. An LED system as claimed in claim 1, wherein the heatsink temperature estimation subunit is configured to estimate the heatsink temperature from an average current through the first string of LEDs and the estimated junction temperature of the LEDs of first string of LEDs.

6. An LED system as claimed in claim 5, wherein the memory unit is configured to store a lookup table defining a temperature difference between the junction temperature of the LEDs of the first string of LEDs and the heatsink temperature for a plurality of average currents, and the heatsink temperature estimation subunit is configured to estimate the heatsink temperature using the lookup table.

7. An LED system as claimed in claim 1, comprising a string of red LEDs, a string of blue LEDs, and a string of green LEDs and wherein the first string of LEDs is the string of red LEDs.

8. A method of estimating the temperature of a plurality of strings of LEDs each having a junction and mounted on a common heatsink and being supplied by a respective current, the method comprising:

estimating the junction temperature of a first string of LEDs of the plurality of strings of LEDs;

estimating the temperature of the heatsink from the estimate of the junction temperature of the first LED; and estimating the junction temperature of a second string of LED of the plurality of strings of LEDs from the estimated temperature of the heatsink.

9. The method of claim 8, wherein estimating the temperature of the first string of LEDs comprises measuring a first voltage across the string of LEDs during a high current time of a first LED PWM current, measuring a second voltage across the string of LEDs during a low current time of the first LED PWM current, and estimating the junction temperature from a difference between the first and second voltages.

10. The method of claim 9, wherein the temperature of the heatsink is estimated from an average current through the first string of LEDs and the estimated junction temperature of the first string of LEDs.

11. The method of claim 10, wherein a temperature offset between the first string of LEDs' junction temperature and the heatsink is determined from the average current using a lookup table.

12. The method of claim 8, wherein the temperature of a second string of LEDs of the plurality of strings of LEDs is estimated from the estimated temperature of the heatsink and an average current through the second string of LEDs.

13. The method of claim 8, wherein the plurality of LEDs comprises a string of red LEDs being the first string of LEDs, and at least one of a string of blue LEDs and a string of green LEDs.

14. A program for a computer, stored on at least one non-transitory, tangible machine readable storage medium containing executable machine instructions for causing the computer to configure an LED lighting system as disclosed herein to perform the method of claim 8.

* * * * *